US006702067B2

(12) United States Patent
Iversen et al.

(10) Patent No.: US 6,702,067 B2
(45) Date of Patent: Mar. 9, 2004

(54) PISTON COMPRESSOR, PARTICULARLY HERMETICALLY ENCLOSED REFRIGERANT COMPRESSOR

(75) Inventors: Frank Holm Iversen, Padborg (DK); Preben Bjerre, Sønderborg (DK)

(73) Assignee: Danfoss Compressors GmbH, Flensburg (DE)

( * ) Notice: Subject to any disclaimer, the term of this patent is extended or adjusted under 35 U.S.C. 154(b) by 104 days.

(21) Appl. No.: 09/972,394

(22) Filed: Oct. 5, 2001

(65) Prior Publication Data

US 2002/0050424 A1 May 2, 2002

(30) Foreign Application Priority Data

Oct. 28, 2000 (DK) ..... 100 53 574

(51) Int. Cl.[7] ..... F01M 1/00
(52) U.S. Cl. ..... 184/6.16; 415/88; 417/217.1
(58) Field of Search ..... 184/6.16; 415/88; 417/217.1

(56) References Cited

U.S. PATENT DOCUMENTS 3,451,615 A 6/1969 Hoover ..... 230/206
3,912,044 A * 10/1975 Schindelhauer ..... 184/6.16
4,478,559 A 10/1984 Andrionne et al. ..... 417/368
4,865,527 A * 9/1989 Piera et al. ..... 417/368
5,842,420 A * 12/1998 Khoo et al. ..... 184/6.16

FOREIGN PATENT DOCUMENTS

DE 2724830 12/1978 ..... F04B/39/02

* cited by examiner

*Primary Examiner*—David Fenstermacher
(74) *Attorney, Agent, or Firm*—McCormick, Paulding & Huber LLP

(57) ABSTRACT

The invention relates to a piston compressor, particularly a hermetically enclosed refrigerant compressor, with a crankshaft, which is axially supported in an axial bearing in relation to a bearing housing, and with an oil pump arrangement.

In a piston compressor of this kind, it is endeavored to improve the lubricating properties.

For this purpose, an oil distribution channel extending in the circumferential direction is arranged in the axial bearing between the crankshaft and the bearing housing, a control arrangement being arranged between the oil pump arrangement and the oil distribution channel, which control arrangement connects the oil pump arrangement with the oil distribution channel for a predetermined, short period, at least once during each rotation of the crankshaft.

9 Claims, 4 Drawing Sheets

PISTON COMPRESSOR, PARTICULARLY HERMETICALLY ENCLOSED REFRIGERANT COMPRESSOR

FIELD OF THE INVENTION

The invention relates to a piston compressor, particularly a hermetically enclosed refrigerant compressor, with a crankshaft, which is supported in an axial bearing in relation to a bearing housing, and with an oil pump arrangement.

BACKGROUND OF THE INVENTION

A piston compressor of this kind is known from U.S. Pat. No. 3,451,615. An oil pump arrangement working by means of centrifugal force is arranged at the lower end of the crankshaft, the oil pump arrangement immersing in an oil sump and supplying oil through the crankshaft to a bearing housing, in which the crankshaft is radially and axially supported. In the area of the radial bearing, the crankshaft has a spirally extending lubricating groove, through which the oil from the oil pump arrangement is supplied. Axially above the bearing housing, the crankshaft has a radially projecting flange, which is supported on the bearing housing, and forms an axial bearing together with the bearing housing. The lubricating groove extends up to this area, so that, for lubricating purposes, oil supplied through the lubricating groove also reaches the area of the axial bearing.

A similar embodiment is known from DK 164 828 B. Also here the crankshaft has a spirally extending groove on its surface, with which it is supported in a bearing housing.

In the area of the axial bearing, oil from the end of the lubricating groove, which rotates with the crankshaft, reaches the radial inner area of the axial bearing, from where it must spread axially outwards. However, it is not always ensured that sufficient oil reaches the axial bearing to be spread over the complete bearing surface. Occasionally, radially extending channels have been provided in the axial bearing, which should ensure an improved transport of the oil radially outwards. However, such a channel or such channels also cause that near these channels the oil layer has only a limited load-bearing capability. This requires the use of a lubricating oil with a relatively high viscosity. This again causes an increased energy consumption.

SUMMARY OF THE INVENTION

The invention is based on the task of improving the lubricating properties.

With a piston compressor as mentioned in the introduction, this task is solved in that in the axial bearing between the crankshaft and the bearing housing an oil distribution channel extending in the circumferential direction is arranged, a control arrangement being arranged between the oil pump arrangement and the oil distribution channel, which control arrangement connects the oil pump arrangement with the oil distribution channel for a predetermined, short period, at least once during each rotation of the crankshaft.

With this embodiment it is ensured that the oil can be supplied into the oil distribution channel with a higher pressure. This higher pressure is, among other things, generated in that the oil cannot flow permanently into the oil distribution channel, but only when the control arrangement releases the connection between the oil pump arrangement and the oil distribution channel. Thus, oil pulses occur, which cause a somewhat higher pressure of the oil in the oil distribution channel. This causes an improvement of the support of the crankshaft in the bearing housing. It also leaves more freedom in connection with the selection of the placing of the oil channel, that is, the oil channel does not have to be arranged in the immediate proximity of the bore, through which the crank shaft is guided. This permits an additional improvement of the oil distribution, as the oil must no longer flow through the total radial extension of the axial bearing, but, for example, can be supplied in a central area, so that it can penetrate radially inwards and outwards. As, through a design measure, it has now been ensured that the lubrication is improved, an oil with a lower viscosity can be used. This oil causes lower losses, so that the efficiency can be improved. With the same pump output, the supplied amount of oil is increased, so that again the oil pressure in the oil distribution channel increases, which again causes better lubricating properties.

Preferably, the control arrangement is controlled by the crankshaft. As the oil pulse must be generated at least once per rotation of the crankshaft, the control by means of the crankshaft provides a certain automation that needs no further monitoring.

It is also preferred that the oil pump arrangement is connected with at least one lubricating groove on the circumference of the crankshaft, which groove overlaps the opening of an oil supply channel on a rotation of the crankshaft, the other end of the oil supply channel opening into the oil distribution channel. The lubricating groove is known per se. Together with the opening of the oil supply channel, it forms the control arrangement, which ensures that on each rotation a connection from the oil pump arrangement to the oil distribution channel can be established at least once. This connection occurs, when, on a rotation of the crankshaft, the spirally extending lubricating groove (or grooves) overlap the opening of the oil supply channel. When this overlapping is not established, the opening is covered by the circumferential surface of the crankshaft, so that the oil from the oil distribution channel cannot flow back, but is used completely for the lubrication of the axial bearing. The fact that the supply of the oil distribution channel per rotation only takes a short time, the remaining time can be spent on building up a higher pressure in the lubricating groove. When the lubricating groove overlaps the opening of the oil supply channel, this higher pressure will be passed on to the oil distribution channel.

Preferably, the lubricating groove ends at a predetermined distance before the axial bearing, and the opening of the oil supply channel overlaps the end of the lubricating groove. This ensures a relatively exact definition of the allocation between the lubricating groove and the opening of the oil supply channel. At the end of the oil supply channel an oil backup may be generated, which again leads to a pressure increase, which can propagate through the oil supply channel into the oil distribution channel.

Preferably, the end of the lubricating groove is provided with an inclined wall. On a rotation of the crankshaft, this inclined wall pushes the oil ahead of itself and thus generates a pressure component radially outwards. When this inclined wall is led past the opening of the oil supply channel, it presses the oil further into the oil supply channel, which causes an additional pressure increase in the oil supply channel. That is, the inclined wall increases the amplitude of the oil pulse.

Preferably, an oil pocket is formed at the end of the lubricating groove. The oil pocket is somewhat extended in the axial direction. Thus, a larger oil supply is available, which can be pumped into the oil distribution channel over a longer period.

Preferably, the oil supply channel is inclined in relation to the rotational axis of the crankshaft. Thus, the oil distribution channel can be arranged radially further outwards.

Preferably, the oil distribution channel is divided into several sections in the circumferential direction, each section being supplied separately. This increases the number of oil pulses per rotation of the crankshaft. This leads to an increase of the amount of oil pumped into the axial bearing per rotation of the crankshaft. As the individual sections of the oil distribution channel are smaller, that is, have a smaller volume, this leads to an additional pressure increase of the oil in the axial bearing.

In this connection, it is preferred that each section has an oil supply channel. This oil supply channel of each section will then overlap the lubricating groove on the circumference of the crankshaft exactly once per rotation of the crankshaft. This is a relatively simple opportunity of establishing a control arrangement for each section of the oil distribution channel.

BRIEF DESCRIPTION OF THE DRAWINGS

In the following, the invention is explained by means of a preferred embodiment in connection with the drawings, showing.

DETAILED DESCRIPTION OF THE PREFERRED EMBODIMENTS

Figure 1:
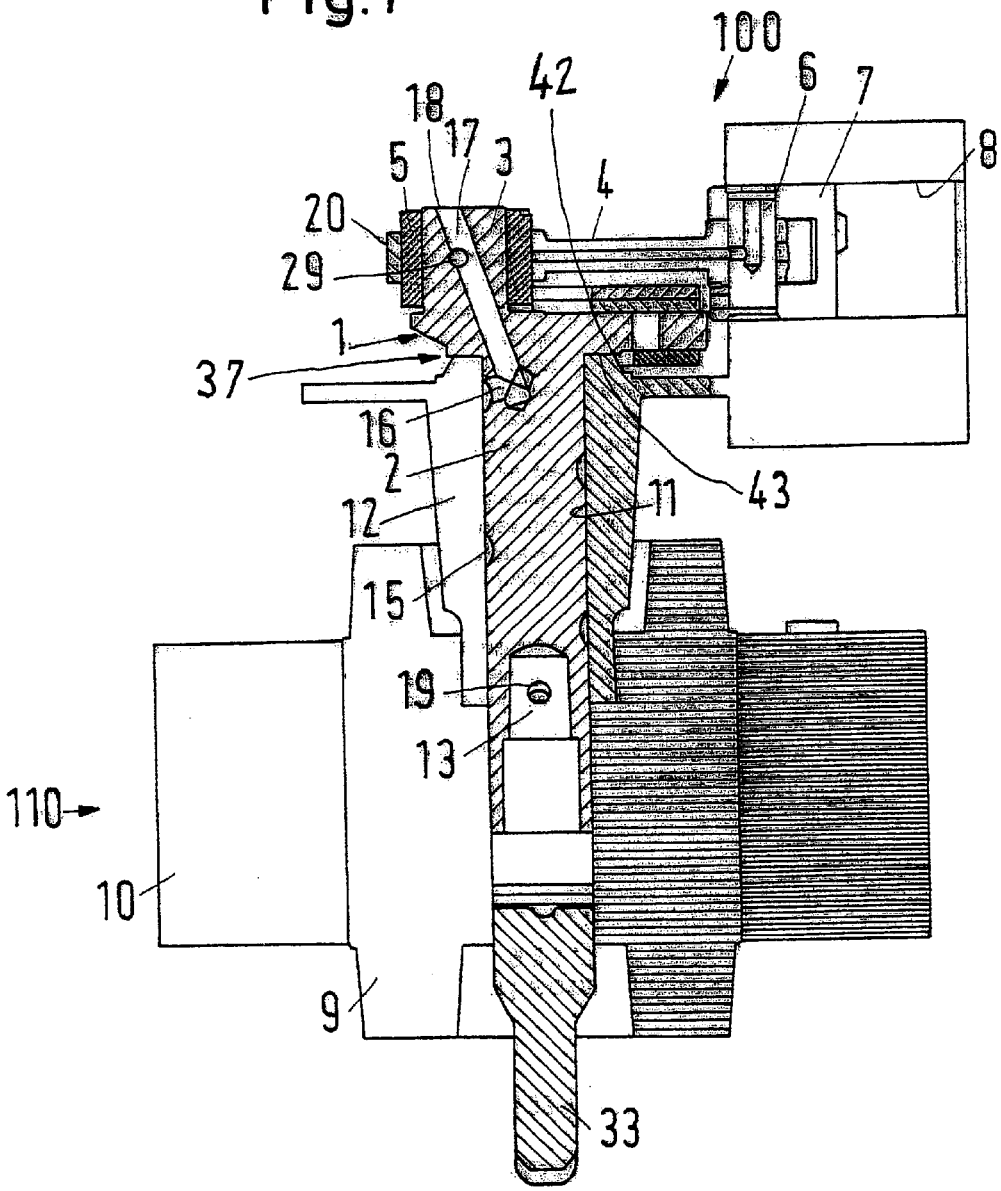
FIG. 1 a schematic side view of a piston compressor, partially in section
Figure 2:
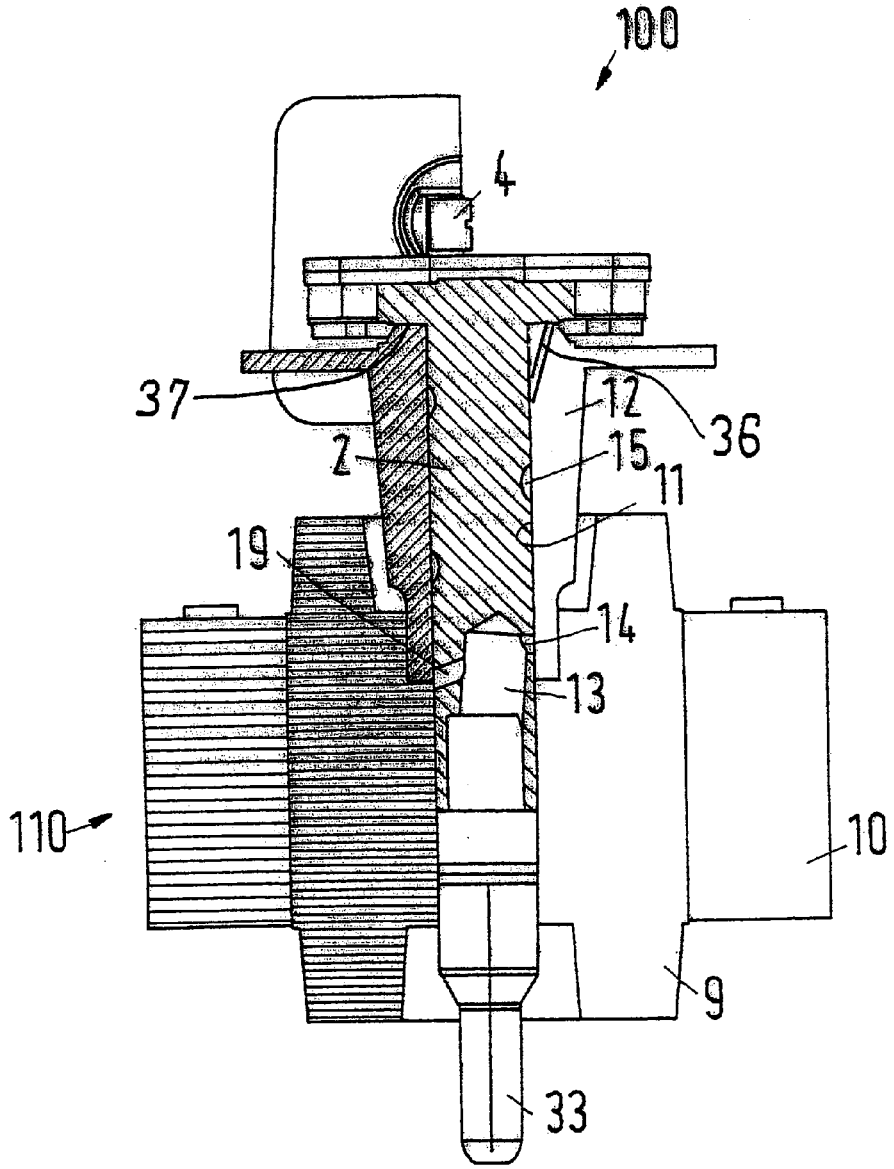
FIG. 2 a schematic front view of the piston compressor, partially in section FIG. 3 a perspective view of a radial and axial bearing, partially in section FIG. 4 a perspective view of part of the axial bearing, partially in section FIG. 5 a schematic sectional view through the crankshaft and the compressor block at the end of a lubricating groove

The FIGS. 1 and 2 show a piston compressor 100 with a piston 7, which is arranged in a cylinder 8. For the compression of a refrigerant, the refrigerant is sucked into the cylinder 8 via a valve arrangement, which is not shown in detail, when the piston in FIG. 1 moves to the left, and is compressed, when the piston 7 moves to the right. The piston is driven by an electric motor 110, which has a stator 10, in which a rotor 9 is rotatably supported. The conversion of the rotary movement of the rotor 9 into the translatory movement of the piston takes place by means of a crank drive 1. The crank drive 1 has a crankshaft 2, one end of which having a crank pin 3. Under the intermediary of a bearing element 5, the crank pin 3 is connected with a connecting rod 4, which surrounds the bearing element 5 by means of a connecting rod eye 20. The other end of the connecting rod 4 is rotatably supported on a piston bolt 6.

The crankshaft 2 is supported in a main bearing 11, which is formed in a compressor block serving as bearing housing 12. Below the crankshaft 2 is arranged an oil pump 33 for the supply of lubricating oil from an oil sump, which is not shown in detail, the oil pump also being fixedly connected with the rotor 9. The oil pump 33 supplies the oil from the oil sump in a manner known per se by means of centrifugal forces.

During the rotation of the crankshaft, the oil supplied by the oil pump 33 first reaches a blind bore 13 at the lower end of the crankshaft 2. The axis of the blind bore 13 is slightly inclined in relation to the axis of the crankshaft 2, which is particularly obvious from FIG. 2. During a rotation of the crankshaft 2, the sucked oil is therefore pressed radially outwards by the centrifugal force, and accordingly flows upwards along the radial outer wall of the blind bore 13 until it reaches a radial bore 14, which connects the blind bore 13 with a spirally extending groove 15 arranged on the outside of the crankshaft 2 in the area of the main bearing 11. Thus, in the area of the radial support of the crankshaft 2 in the bearing housing a lubrication by means of an oil layer is ensured. The spirally extending groove 15 is consequently also called "lubricating groove" 15. Of course, more than one lubricating groove 15 can be provided.

At the upper end of the bearing housing 12 an axial bearing 37 is formed, in which the crankshaft 2 is supported with a radially extended flange 42 on the front side 43 of the bearing housing 12.

The lubricating groove 15 ends at a predetermined distance from the bottom of the axial bearing 37. At the end of the lubricating groove 15, a second radial bore 16 is arranged in the crankshaft 2, through which bore the oil from the lubricating groove 15 can re-enter into the crankshaft 2, before it passes a channel 17 through the crank pin 3, the channel 17 also being inclined in relation to the axis of the crankshaft 2, and reaches the upper front side of the crank pin 3. Here, the oil can flow out through an opening 18 in the channel 17. An additional opening 29 is provided in the side of the channel 17, to enable the supply of oil also to bearings between the connecting rod 4 and the crank pin 3 or the bearing element 5, respectively, and between the connecting rod 4 and the piston bolt 6. The radial bore 16 is dimensioned so that at the end of the lubricating groove 15 the oil is somewhat dammed up.

For the venting of the oil, a bore 19 is led out from the blind bore 13 in the crankshaft 2. Preferably, the bore 19 is made together with the bore 14, and ends on the outside of the crankshaft 2 at the level of a gap between the rotor 9 and the bearing housing 12. Through the bore 19 gaseous refrigerant can escape from the oil.

On the end lying next to the axial bearing 37, the bearing housing 12 has an oil supply channel 36, which is inclined in relation to the axis of the crankshaft 2. This oil supply channel 36 has an opening 38 into the bore, which forms the main bearing 11 in the bearing housing 12. The other end 39 of the oil supply channel 36 opens between the crankshaft 2 and the bearing housing 12, more precisely, between the flange 42 and the front side 43.

Figure 3:
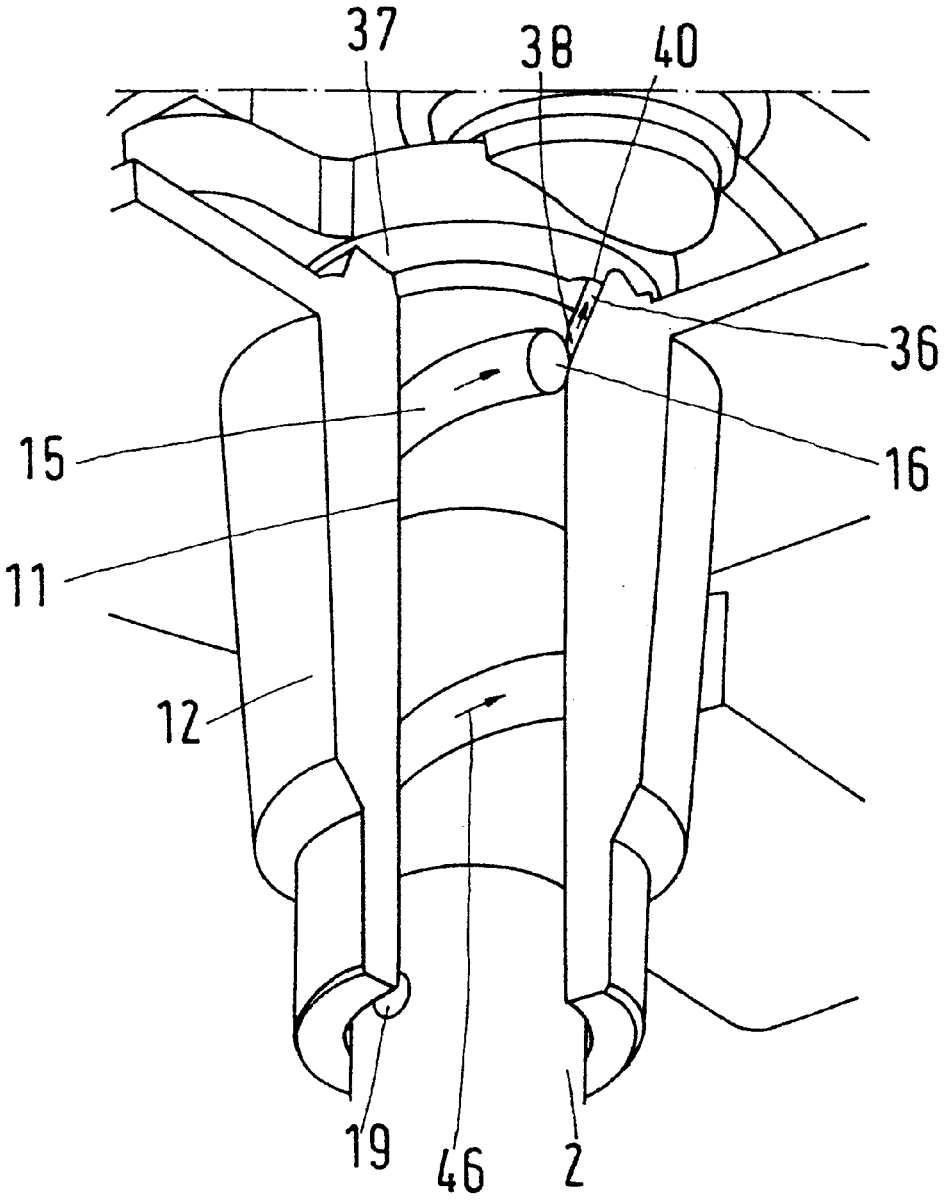
Figure 4:
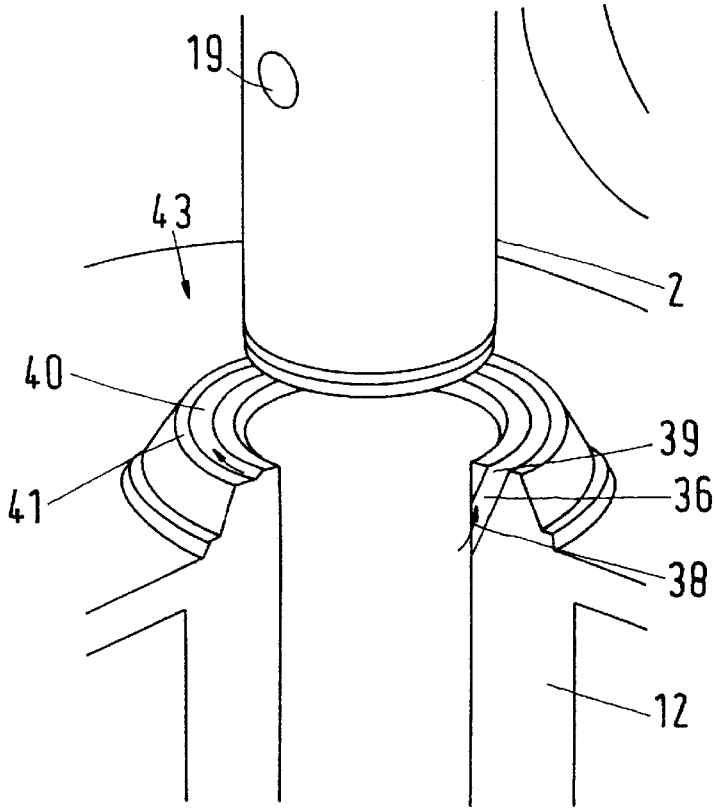

As is particularly obvious from FIGS. 3 and 4, an oil distribution channel 40 is provided in the area of this axial bearing 37, which channel 40 is provided in the front side 43 of the bearing housing 12, more precisely, approximately in the radial centre of an axial bearing surface 41 of the bearing housing 12.

As shown in FIG. 4, the oil distribution channel 40 can have an extension, which is closed in the circumferential direction, which only requires one oil supply channel 36. However, the oil distribution channel can also be divided into several sections in the circumferential direction (not shown), each section then having its own oil supply channel 36.

In FIG. 4, the crankshaft 2 is pulled out of the bearing housing, to give a better view of the opening 38 of the oil supply channel.

Figure 5:
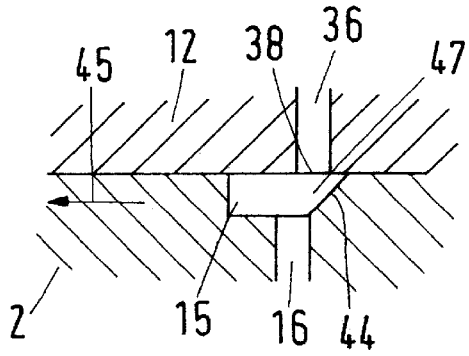

From FIG. 5 it can be seen that the end 47 of the lubricating groove 15 is provided with an inclined wall 44, so that a movement of the crankshaft 2 in the direction of an arrow 45 in relation to the bearing housing will result in an additional oil supply in the oil supply channel 36.

The supply of oil from the oil sump takes place in a known manner, on the one hand through the effect of the centrifugal force, on the other hand by means of frictional forces, when, during a rotation of the crankshaft, the inclined longitudinal wall of the spiral groove takes along the oil and transports it further upwards.

This oil then dams up at the end of the spiral groove, the size of the opening 16 being chosen so that the generated pressure is sufficient to push the oil back into the inside of the shaft against the centrifugal force.

An additional pressure increase and thus also pump effect in the oil supply channel occurs through the end of the spiral groove, where, in a manner of speaking, the inclined end face pushes the oil "sticking" to its wall in front of it, when the shaft rotates.

The direction of movement, shown in FIG. 5, of the crankshaft 2 in relation to the bearing housing 12, corresponds to a clockwise rotation of the crankshaft 2, when compared with the drawing in FIG. 3. As shown by means of the arrows 46, this rotation will cause oil to flow from the oil sump through the lubricating groove 15 in the direction of the axial bearing 37. Part of the oil will flow off through the bores and channels 16 to 18, 29. With the corresponding dimensioning, however, a certain oil pressure will appear at the end 47 of the lubricating groove 15. Together with the additional pump effect of the inclined end face, this oil pressure will then cause an oil pulse in the oil distribution channel 40, when the lubricating groove 15 overlaps the opening 38 of the oil supply channel 36. Thus, together with the opening 38 of the oil supply channel 36, the lubricating groove 15 forms a control arrangement, which ensures, during a rotation of the crankshaft 2, that a corresponding oil pulse occurs in the oil distribution channel 40. With several lubricating grooves 15, also several pulses occur. This oil pulse leads to a pressure increase in the oil distribution channel 40, which again causes a sufficient load-bearing capability of the oil film in the axial bearing 37, thus ensuring a reduced friction and a reduced wear.

It may also be provided, as shown schematically in FIG. 3, that in the circumferential direction the end of the lubricating groove 15 is somewhat expanded to form an oil pocket. This oil pocket then provides a somewhat larger oil supply under the somewhat higher pressure, which can be pumped into the oil supply channel 36 over a somewhat extended period. This means an additional improvement of the supply to the oil distribution channel 40.

It is shown that the oil distribution channel 40 is made in the front side 43 of the bearing housing 12. Of course, the oil distribution channel 40 can also be made in the flange 42 of the crankshaft 2 or in both parts forming the axial bearing 37.

What is claimed is:

1. A hermetically enclosed piston compressor, comprising a refrigerant compressor, comprising a crankshaft, which is supported in an axial bearing in relation to a bearing housing, and with an oil pump arrangement, wherein the axial bearing defines an oil distribution channel between the crankshaft and the bearing housing, and a control arrangement arranged between the oil pump arrangement and the oil distribution channel, which control arrangement connects the oil pump arrangement with the oil distribution channel, at least once during each rotation of the crankshaft, and wherein oil is supplied to the axial bearing via oil pulses with at least one pulse being delivered into the distribution channel during each rotation of the crankshaft.

2. A compressor according to claim 1, wherein the control arrangement is controlled by the crankshaft.

3. A compressor according to claim 1, wherein the oil pump arrangement is connected with at least one lubricating groove on the circumference of the crankshaft, which groove overlaps the opening of an oil supply channel on a rotation of the crankshaft, and the other end of the oil supply channel opening into the oil distribution channel.

4. A compressor according to claim 3, wherein the lubricating groove ends at a predetermined distance before the axial bearing, and the opening of the oil supply channel overlaps the end of the lubricating groove.

5. A compressor according to claim 4, wherein the end of the lubricating groove is provided with an inclined wall.

6. A compressor according to claim 4, further comprising an oil pocket formed at the end of the lubricating groove.

7. A compressor according to claim 3, wherein the oil supply channel is inclined in relation to a rotational axis defined by the crankshaft.

8. A compressor according to claim 1, wherein the oil distribution channel is divided into several sections in the circumferential direction, each section being supplied separately.

9. A compressor according to claim 8, wherein each section defines an oil supply channel.

* * * * *